United States Patent [19]

Kuribayashi et al.

[11] Patent Number: 4,935,325

[45] Date of Patent: Jun. 19, 1990

[54] TONER AND IMAGE FORMING METHOD USING MAGNETIC MATERIAL WITH SPECIFIC TAP DENSITY AND LINSEED OIL ABSORPTION

[75] Inventors: Tetsuya Kuribayashi, Tokyo; Hitoshi Uchide, Kawasaki, both of Japan

[73] Assignee: Canon Kabushiki Kaisha, Tokyo, Japan

[21] Appl. No.: 240,218

[22] Filed: Sep. 6, 1988

[30] Foreign Application Priority Data

Sep. 10, 1987 [JP] Japan ..... 62-225157

[51] Int. Cl.[5] ..... G03G 9/14

[52] U.S. Cl. ..... 430/106.6; 430/129; 430/903; 252/62.56

[58] Field of Search ..... 430/122; 252/62.56, 252/62.55, 106.6, 903

[56] References Cited

U.S. PATENT DOCUMENTS 4,108,786 8/1978 Takayama et al. ..... 252/62.54
4,146,504 3/1979 Deffeyes ..... 252/62.55
4,675,268 6/1987 Kishi et al. ..... 430/126
4,680,245 7/1987 Suematsu et al. ..... 430/122
4,781,851 11/1988 Steck et al. ..... 252/62.56

FOREIGN PATENT DOCUMENTS 0070117 1/1983 European Pat. Off. .
55-130547 9/1980 Japan .

*Primary Examiner*—John L. Goodrow
*Attorney, Agent, or Firm*—Fitzpatrick, Cella, Harper & Scinto

[57] ABSTRACT

A magnetic toner suitably used for developing a digital latent image is provided. The magnetic toner comprises a binder resin and a specific magnetic material comprising spherical magnetic particles which have a tap density of 1.2–2.5 g/cm$^3$ and a linseed oil absorption of 5–30 ml/100 g. On the basis of the characteristics of the above-mentioned magnetic material, the magnetic toner has good image forming characteristics including image density, reproducibility of thin lines and resolution.

31 Claims, 4 Drawing Sheets

TONER AND IMAGE FORMING METHOD USING MAGNETIC MATERIAL WITH SPECIFIC TAP DENSITY AND LINSEED OIL ABSORPTION

FIELD OF THE INVENTION AND RELATED ART

The present invention relates to a magnetic toner containing spherical magnetic particles, a one component-type developer containing the magnetic toner and an image forming method using the developer. The developer according to the present invention may suitably be used in an electrophotographic image forming method in order to develop a digital latent image comprising unit pixels represented by ON-OFF, or a finite gradation.

Generally, in the electrophotographic system, an original image is exposed to light and the resultant reflected light is supplied to a latent image-carrying member to obtain a latent image thereon. In this system, because the light reflected from the original image is used for an image signal as such, the resultant latent image is an analog-type (hereinafter, referred to as "analog latent image") wherein the potential is continuously changed.

On the other hand, there has recently been commercialized a system wherein light reflected from an original image is converted into an electric signal which is then processed, and thereafter exposure is effected according to the processed signal. This system has various advantages such that image enlargement or power reduction is effected easier than in the system using the analog latent image and the image signal can be fed into a computer and output in combination with other information. However, if the analog image signal is handled as such, the signal content becomes enormous. Accordingly, the above-mentioned system requires digital processing wherein an image is divided into pixel units (hereinafter, each pixel may be referred to as "dot"), and exposure quantities are determined with respect to the respective pixels.

In a case where a latent image is digitized, it is necessary to develop each dot more precisely than previously, using the conventional analog latent image. Accordingly, there is required a developer which is capable of providing a high image density and capable of developing respective pixels faithfully. Further, when a digital latent image is formed, it generally provides a deviation in surface potential which is larger than that in an analog latent image. Therefore, when the digital latent image is developed, it is necessary to develop portions of the latent image wherein the potential difference between a developer-carrying member and a latent image-bearing member such as a photosensitive drum is relatively small. Such development is particularly important in an image having a repetitive pattern of alternating image and non-image dots.

Accordingly, when a developer intended for developing an analog latent image is applied to a system using a digital latent image, dots are insufficiently developed, particularly in the case of the above-mentioned repetitive image pattern comprising alternating image and non-image dots. As a result, there occurs a phenomenon such that some dots provide reduced or no developed images, whereby the resultant image density is decreased or a letter image is blurred, as a whole. Such phenomenon is quite noticeable when the developer comprises a toner containing magnetic material (hereinafter, referred to as "magnetic developer") which is liable to provide a relatively small amount of triboelectric charge. The reason for this may be considered that in the magnetic developer, the magnetic material protrudes from some surface portions of the toner particles, and so the surface area capable of contributing to the triboelectrification is decreased. Since the amount of the magnetic material protruding from the toner particle surfaces varies depending on the amount of the magnetic material contained in each magnetic toner particle, the distribution of triboelectric charge (amount) becomes broader than that in another type of developer. As a result, when the conventional magnetic developer is used in a system using a digital latent image, blurring of a letter image is liable to occur since developer particles having a small amount of triboelectric charge are accumulated in a developing apparatus.

In order to narrow the triboelectric charge distribution in the developer, the magnetic material may, for example, be dispersed more uniformly in a binder resin. As a method used for such uniform dispersion, the magnetic material can be surface-treated with a treating agent such as a titanium coupling agent to make a magnetic particle surface lipophilic. However, such treating agent is expensive and the process for the surface treatment is complex, whereby the production cost is undesirably increased.

On the other hand, Japanese Laid-Open patent application (JP-A, KOKAI No. 71529/1985) discloses a process for producing spherical magnetite particles having a good dispersibility in a resin. Although the spherical magnetite particles have a higher dispersibility than conventional magnetic particles in a cubic crystal system, the dispersibility thereof is still insufficient.

SUMMARY OF THE INVENTION

An object of the present invention is to provide a magnetic toner or developer capable of providing a large amount of triboelectric charge.

Another object of the present invention is to provide a magnetic toner or developer capable of providing a toner image with a high image density.

A further object of the present invention is to provide a magnetic toner or developer which is excellent in resolution and reproducibility of a thin line, and which can suitably be used for developing a digital latent image.

A further object of the present invention is to provide a magnetic toner or developer with excellent environmental stability.

A further object of the present invention is to provide a magnetic toner or developer which is less liable to damage a photosensitive member surface.

A still further object of the present invention is to provide an image forming method wherein a digital electric latent image is developed by using the above-mentioned magnetic toner or developer thereby to form a toner image.

According to the present invention, there is provided a magnetic toner, comprising a binder resin and a magnetic material comprising spherical magnetic particles, wherein the magnetic material has a tap density of 1.2–2.5 g/cm$^3$ and a linseed oil absorption of 5–30 ml/100 g.

The present invention also provides a negatively chargeable one component-type developer, comprising a negatively chargeable magnetic toner and negatively chargeable hydrophobic silica fine powder, the magnetic toner comprising a binder resin, a negative charge controller, and a magnetic material comprising spherical magnetic particles, wherein the magnetic material has a tap density of 1.2–2.5 g/cm$^3$ and a linseed oil absorption of 5–30 ml/100 g.

The present invention further provides an image forming method, comprising:

forming a digital latent image on the surface of a latent image-bearing member, forming a layer of the developer of the present invention comprising a magnetic toner on a developer-carrying member, and triboelectrically charging the magnetic toner, transferring the magnetic toner having triboelectric charge from the developer-carrying member to the latent image-bearing member in a developing position in the presence of an alternating electric field or a pulse electric field, thereby to form a toner image on the latent image-bearing member.

As a result of our research, it has been discovered that the dispersibility of spherical magnetic particles in a resin is further enhanced by disintegrating the aggregate or agglomerate thereof in the final stage of the production process therefor, and making their tap density larger than that of the conventional magnetic particles.

Incidentally, when the aggregate of the conventional magnetic material in a cubic crystal system is disintegrated, it has been found that even primary particles are broken by wearing, and that the magnetic material fine powder produced by the breakage tends to adversely affect development when the thus prepared magnetic material is used in a magnetic toner.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
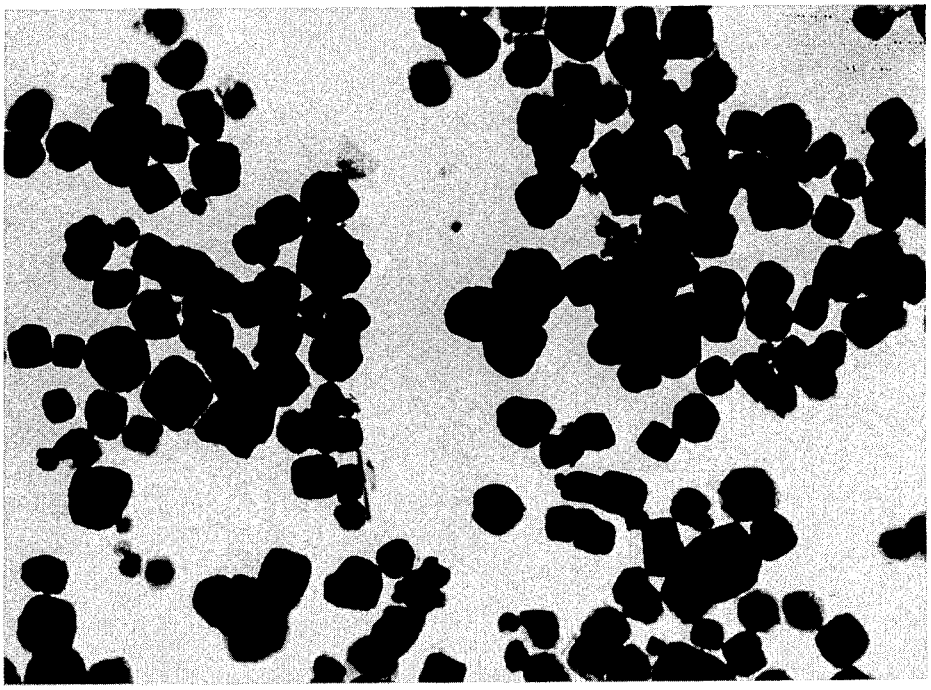
FIG. 1 is a photograph of spherical magnetic particles according to the present invention (magnification: 30,000), which was formed by scanning electron microscope (SEM).

The magnetic toner according to the present invention comprises a binder resin and spherical magnetic particles having a specific tap density and a specific linseed oil absorption.

More specifically, the spherical magnetic particles used in the present invention have a tap density (or pack bulk density) of 1.2–2.5 g/cm$^3$, preferably 1.5–2.0 g/cm$^3$, and a linseed oil absorption of 5–30 ml/100 g, preferably 10–25 ml/100 g, more preferably 12–17 ml/100 g.

In the present invention, the tap density of the magnetic material may be measured by means of an instrument for measurement, Powder Tester (mfd. by Hosokawa Micron K.K.) and a container attached to the Powder Tester, according to the procedure described in the instruction manual for the above-mentioned Powder Tester.

More specifically, the tap density (or apparent density) may be measured in the following manner.

An attachment cap is added to a measurement cap for measuring apparent density, and then the cup is loaded in the tapping holder of the above-mentioned Powder Tester. Sample powder is charged in the cup gently and sufficiently up to the upper portion of the cap the upper portion of the cap is equipped by using an attachment scoop, and with an attachment cap cover in order to prevent the scattering of the sample powder disposed in the measurement cup.

The "vibration-tapping" changeover switch of the Powder Tester is adjusted to "TAP." for tapping. When a power supply for supplying an AC voltage of 50 Hz is used, the timer is adjusted to 216 sec. so that the number of taps is 180.

The start button is pushed so that the tapping operation starts. In the tapping operation, when the sample powder is compressed so that the upper level thereof is lowered to the upper portion of the measurement cup, the "vibration-tapping" changeover switch is adjusted to "OFF" so that the tapping operation pauses. The cap cover is once removed and the sample powder is further added to the measurement cup, and thereafter the tapping operation is continued until the number of the taps reaches 180.

After the tapping operation is completed, the measurement cup is taken out from the tapping holder, and the attachment cap and the cap cover is gently removed therefrom. Then, excess powder disposed over the top of the measurement cup is removed by an attachment blade. Thereafter, the sample powder is weighed accurately by an even balance.

As the inner volume of the cup for measurement is 100 cm$^3$, the tap density (g/cm$^3$) of the sample powder is obtained as the sample weight (g)/100.

On the other hand, the linseed oil absorption of the magnetic material used in the present invention may be measured according to the method described in JIS K 5101-1978 (pigment testing method).

More specifically, the linseed oil absorption may be measured in the following manner.

1–5 g of a sample powder is disposed on a glass plate (about 250×250×5 mm), and boiled linseed oil is slowly dropped from a buret to the central portion of the sample powder, while sufficiently kneading the whole sample powder whenever a small portion of the linseed oil is dropped to the sample.

The above-mentioned operation of dropping and kneading are repeated until the whole sample is converted into a hard putty-like single mass for the first time, and the surface of the mass has gloss due to the linseed oil, i.e., the operation reaches the end point. The amount of the linseed oil used until the end point is measured, and the linseed oil absorption G (%) is calculated according to the following formula:

$$G = H/S \times 100$$

G: the amount of the linseed oil (ml)

S: the mass (or weight) of the sample (g)

Incidentally, some species of pigments cannot provide the above-mentioned surface gloss. Thus, when such pigment is used as the sample, the end point may be defined as a point immediately before one such that the sample is abruptly softened due to the one drop of the boiled linseed oil, and adheres to the glass plate.

Figure 2:
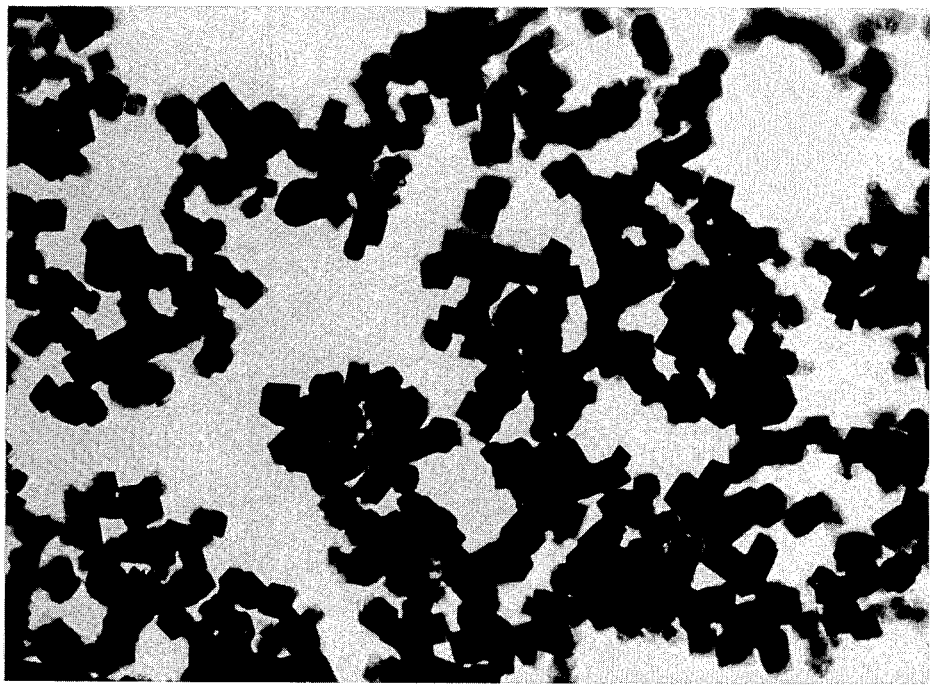
FIG. 2 is a photograph of conventional magnetic particles in a cubic crystal form (magnification: 30,000), which was formed by scanning electron microscope.

The conventional magnetic material comprising magnetite particles in the cubic crystal system as shown in FIG. 2 shows a tap density of below 0.6 g/cm$^3$, and ordinarily shows a tap density in the range of 0.3–0.5 g/cm$^3$. On the other hand, the conventional magnetic material comprising spherical magnetite particles shows a tap density of below 1 g/cm$^3$, and ordinarily shows a tap density in the range of 0.7–0.9 g/cm$^3$.

Figure 5:
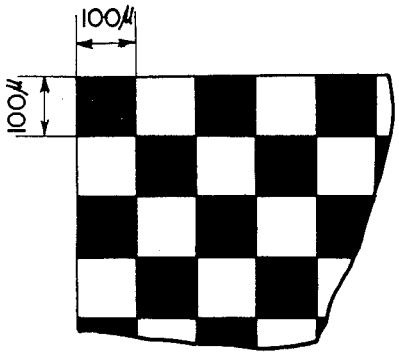
FIG. 5 is a partial view showing an image sample comprising a checkered pattern which was used in a developing test for evaluating the developing characteristic of a developer.

In the toner obtained by using the conventional magnetic material of magnetite particles in a cubic crystal system, the dispersibility of the magnetic particles is insufficiently uniform in each toner particle or among toner particles. Accordingly, such toner provides blurred toner images in some cases when used for developing a digital latent image. According to our experiment, when a digital latent image formed from an original image having a checkered pattern as shown in FIG. 5 was developed with a magnetic toner comprising the conventional magnetic particles in a cubic crystal system, it was found that the black image portions were liable to partially drop out and the image forming characteristic of the toner such as resolution of the resultant image was insufficient.

Further, when a magnetic material composed of magnetite particles showing a cubic crystal is subjected to disintegration treatment to disintegrate the aggregate of the magnetite particles, the tap density of the thus treated magnetic material becomes larger, and a magnetic toner containing the treated magnetic material shows an improved developing characteristic as compared with that of a magnetic toner containing untreated magnetic material. However, such improvement is still insufficient.

Moreover, when particles such as cubic crystals having a flat portion therein are subjected to disintegration treatment, the flat surfaces of the particles are liable to closely contact each other and higher energy is required to separate respective particles, as compared with in the case of contact with a curved surface. Further, the magnetic particles in a cubic crystal system have sharp edge portions which can easily be broken due to stress. Accordingly, when the aggregate of the magnetic material in the cubic crystal system is subjected to disintegration treatment, a considerable amount of fine powder is produced, whereby the characteristic of the treated magnetic material (such as BET specific surface area) is changed from the original target value.

On the other hand, spherical magnetite particles which are not subjected to disintegration treatment have an improved dispersibility in a binder resin as compared with that of the magnetic material in the cubic crystal system. However, the tap density thereof is small and the improvement in uniform dispersibility is still insufficient.

In the present invention, spherical magnetic particles having a tap density of 1.2–2.5 g/cm$^3$ is used. This value of the tap density is large enough that no ordinary untreated cubic crystal magnetic particles, cubic crystal, magnetic particles subjected to disintegration treatment, or untreated spherical magnetic particles can satisfy it.

The specific spherical magnetic particles used in the present invention may preferably be prepared by disintegrating spherical magnetic particles having a tap density of not less than 0.7 g/cm$^3$ and less than 1.0 g/cm$^3$ and a linseed oil absorption of 10–35 ml/100 g.

In order to disintegrate the spherical magnetic particles, there may for example be used a mechanical pulverizer having a high-speed rotor for disintegrating powder, and a pressure-dispersing machine having a load-applying roller for dispersing or disintegrating powder.

In a case where the mechanical pulverizer is used for disintegrating the aggregate of magnetic particles, the impact force due to the rotor is liable to be excessively applied even to the primary particles to break the primary particles per se, whereby fine powder of magnetic material is liable to be produced. Accordingly, when the magnetic material subjected to a disintegration treatment by means of a mechanical pulverizer is used for producing a toner, the above-mentioned fine powder in the magnetic particles deteriorates the triboelectrification characteristic of the toner. As a result, a decrease in toner image density due to the decrease in the triboelectric charge amount in the toner is relatively liable to be occur.

On the other hand, in the present invention, there may preferably be used a pressure dispersing machine having a load-applying roller such as a Fret Mill, in order to effectively disintegrate the aggregates of spherical magnetic particles, and to suppress the production of magnetic material fine powder.

In the present invention, it may be considered that the tap density and the oil absorption of the magnetic material indirectly represent the shape of the magnetic particles, the surface condition thereof, and the amount of the aggregate present therein.

The tap density of a magnetic material of below 1.2 g/cm$^3$ indicates that a large amount of magnetic particles in a cubic crystal system is present in the magnetic material, or that a large number of magnetic particle aggregates are present therein and the disintegration treatment for the magnetic particles is substantially insufficient. Accordingly, when a magnetic material having a tap density less than 1.2 g/cm$^3$ is used, it is difficult to uniformly disperse the magnetic material in a binder resin, whereby toner image blurring due to the ununiform dispersion of the magnetic material, a decrease in resolving power of the toner, and the damage of a photosensitive member surface are liable to occur.

When the tap density of the magnetic particles is more than 2.5 g/cm$^3$, the aggregates thereof have excessively been disintegrated and the adhesion among the magnetic particles occurs under pressure, whereby pellets thereof are produced. As a result, such magnetic particles can only provide ununiform magnetic toner particles.

When the oil absorption of the magnetic particles overstep the above-mentioned upper or lower limit thereof there occurs, a similar phenomenon as in the case of the tap density.

According to our research, it has been found that when magnetic particles in a cubic crystal system are disintegrated, the BET specific surface area thereof after the disintegration increase by 10% or more, as compared with that before the disintegration. The reason for this may be considered that fine powder of magnetic particles is produced in a large amount due to the disintegration treatment. On the other hand, it has been found that when spherical magnetic particles are disintegrated, the BET specific surface area thereof after the disintegration is substantially the same as that before the disintegration, or decrease by several %.

Accordingly, it is possible to determine whether the shape of the magnetic particles is in a cubic crystal system or spherical. More specifically, in a case where magnetic particles are disintegrated so that the tap density thereof is increased by about 30%, if the BET specific surface area thereof at this time is substantially the same or decreases as compared with that before the disintegration, the shape of the magnetic particles may be considered spherical.

In the present invention, the primary particle size of magnetic particles measured by using a photograph formed by an electron microscope may preferably be in the range of 0.2–0.5 micron, and the BET specific surface area thereof by nitrogen adsorption may preferably be 6.0–8.0 $m^2/g$.

Further, in order to develop a digital latent image in the presence of a magnetic field, the spherical magnetic particles used in the present invention may preferably have a saturation magnetization ($\sigma_s$) of 60–90 emu/g, a residual magnetization ($\sigma_r$) of 3–9 emu/g, and a coercive force ($H_c$) of 40–80 Öe (more preferably 50–70 Öe), and/or a ratio $\sigma_r/\sigma_s$ of 0.04–0.10, as measured at a magnetic field of 10,000 Oe, in view of the conveyability of a magnetic toner on a developer-carrying member such as sleeve. It is very difficult to cause conventional magnetic particles in a cubic crystal system to have a coercive force of 40–80 Öe. Therefore, it may be considered that the abovementioned value of coercive force indirectly indicates the shape of magnetic particles.

In the present invention, the magnetic characteristic of a magnetic material may be measured by means of a measurement device (Model: VSMP-1, mfd. by Toei Kogyo K.K.).

The magnetic toner of the present invention may preferably have an insulating property so as to have triboelectric charge. More specifically, when a voltage of 100 V is applied to the toner under a pressure of 3.0 $kg/cm^2$, the resistivity thereof may preferably be $10^{14}$ Ω·cm or higher. Therefore, in the magnetic toner of the present invention, the abovementioned specific spherical magnetic particles are contained in an amount of 30–150 wt. parts, per 100 wt. parts of a binder resin. If the amount of the magnetic particles is below 30 wt. parts, the conveyability of the magnetic toner on a developer-carrying member such a sleeve is insufficient. On the other hand, if the amount of the magnetic particles is above 150 wt. parts, the insulating property and heat-fixability of the magnetic toner decrease.

The spherical magnetic particles used in the present invention may preferably be prepared from ferrous sulfate according to a wet process. The magnetic particles may preferably comprise magnetite or ferrite which contains 0.1–10 wt. % of a compound comprising a divalent metal such as manganese or zinc.

Examples of the binder resin constituting the magnetic toner according to the present invention include: homopolymers or copolymers of styrene and its derivatives such as polystyrene, poly-p-chlorostyrene, polyvinyltoluene, styrene-p-chlorostyrene copolymer, styrene-vinyltoluene copolymer; copolymers of styrene and acrylic acid esters such as styrene-methyl acrylate copolymer, styrene-ethyl acrylate copolymer, styrene-n-butyl acrylate copolymer; copolymers of styrene and methacrylic acid esters such as styrenemethyl methacrylate copolymer, styrene-ethyl methacrylate copolymer, styrene-n-butyl methacrylate copolymer; multicomponent copolymers of styrene, acrylic acid esters and methacrylic acid esters; copolymers of styrene and other vinyl monomers such as styrene-acrylonitrile copolymer, styrene-vinyl methyl ether copolymer, styrene-butadiene copolymer, styrenevinyl methyl ketone copolymer, styrene-acrylonitrileindene copolymer, styrene-maleic acid ester copolymer; polymethyl methacrylate, polybutyl methacrylate, polyvinyl acetate, polyesters, polyamides, epoxy resins, polyvinyl butyral, polyacrylic acid resin, phenolic resins, aliphatic or alicyclic hydrocarbon resins, petroleum resin, chlorinated paraffin, etc. These binder resins may be used either singly or as a mixture.

In view of the triboelectric chargeability, developing characteristic, and fixability of the toner, there may preferably be used a styrene-acrylic acid alkyl (preferably $C_1$–$C_{12}$) ester copolymer, a styrene-methacrylic acid alkyl (preferably $C_1$–$C_{12}$) ester copolymer, or a polyester resin.

The magnetic toner according to the present invention may further contain a colorant. Examples thereof may include carbon black and copper phthalocyanine.

Further, the toner according to the present invention may also contain as desired, a charge controller (or charge-controlling agent) including a negative charge controller such as a metal complex salt of a monoazo dye; and a metal complex of salicylic acid, alkylsalicylic acid, dialkylsalicylic acid, or naphthoic acid, etc. The toner of the present invention may preferably contain 0.1–0.9 wt. part of the charge controller per 100 wt. parts of a binder resin.

Further, a flowability improver such as teflon powder may be added in order to prevent the agglomeration of toner particles to improve the flowability. It is also a preferred embodiment of the present invention to add to the toner a waxy material such as low-molecular weight polyethylene, low-molecular weight polypropylene, microcrystalline wax, carnauba wax, sasol wax or paraffin wax in an amount of about 0.5–5 wt. %, in order to enhance the releasability at the time of hot-roller fixing.

The spherical magnetic particles according to the present invention may preferably be used in a negatively chargeable magnetic toner. Such negatively chargeable magnetic toner may preferably provide a triboelectric charge amount of −8 μC/g to −20 μC/g. If the charge amount is less than −8 μC/g (in terms of the absolute value thereof), the image density is liable to decrease, particularly under a high humidity condition. If the charge amount is more than −20 μC/g, the toner is excessively charged to make a line image thinner, whereby only a poor image is provided particularly under a low humidity condition.

The negatively chargeable toner particles in the present invention are defined as follows. That is, 10 g of toner particles which have been left to stand overnight in an environment of 25° C. and relative humidity of 50 to 60% RH, and 90 g of carrier iron powder not coated with a resin having particle sizes of 200 mesh-pass and 300 mesh-on (e.g. EFV 200/300, produced by Nippon Teppun K.K.) are mixed thoroughly in an aluminum pot having a volume of about 200 cc in the same environment as mentioned above (by shaking the pot in hands vertically for about 50 times), and the triboelectric charge of the toner particles is measured according to the conventional blow-off method by means of an aluminum cell hving a 400 mesh-screen. The toner particles having negative triboelectric charge through the above measurement are defined as negatively chargeable toner particles.

The toner of the present invention may ordinarily be prepared in the following manner.

(1) A binder resin and a magnetic material are blended by uniform dispersion by means of a blender such as Henschel mixer together with optionally added dye or pigment as a colorant.

(2) The above blended mixture is subjected to melt-kneading by using a kneading means such as a kneader, extruder, or roller mill.

(3) The kneaded product is coarsely crushed by means of a crusher such a cutter mill or hammer mill and then finely pulverized by means of a pulverizer such as a jet mill.

(4) The finely pulverized product is subjected to classification for adjusting the particle size distribution by means of a classifier, thereby to provide a toner of the present invention.

In order to uniformly improve the triboelectric chargeability of the toner particles, to prevent the agglomeration thereof, or to improve the flowability thereof, the developer may preferably comprise a magnetic toner and fine powder of hydrophobic silica. In the case of a negatively chargeable one-component magnetic developer, the developer may preferably contain negatively chargeable fine silica powder treated with a silane coupling agent and/or a silicone oil, preferably in an amount of 0.3–1.0 wt. part per 100 wt. parts of the negatively chargeable magnetic toner.

The fine silica powder used in the present invention may preferably be the so-called "dry process silica" or "fused silica" which can be obtained by oxidation of gaseous silicon halide. The hydrophobic silica fine powder may preferably comprise the abovementioned silica fine particles of which surface has been treated with a silane coupling agent and/or a silicone oil.

A preferred embodiment of the image forming method according to the present invention is described with reference to FIGS. 3 and 4.

Figure 3:
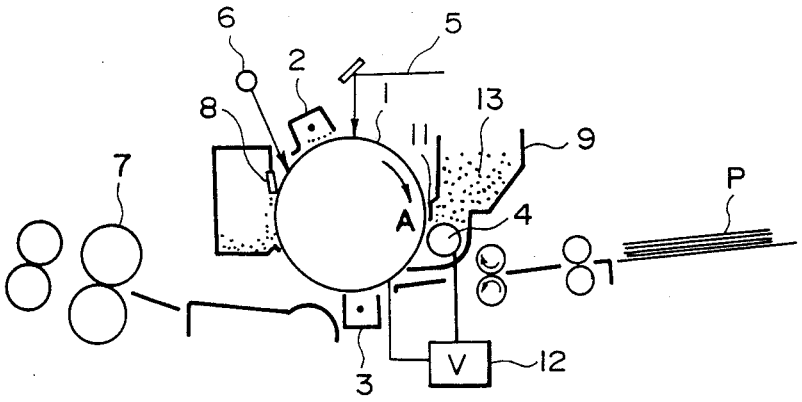
FIG. 3 is a schematic sectional view showing an apparatus for practicing the image forming method according to the present invention.
Figure 4:
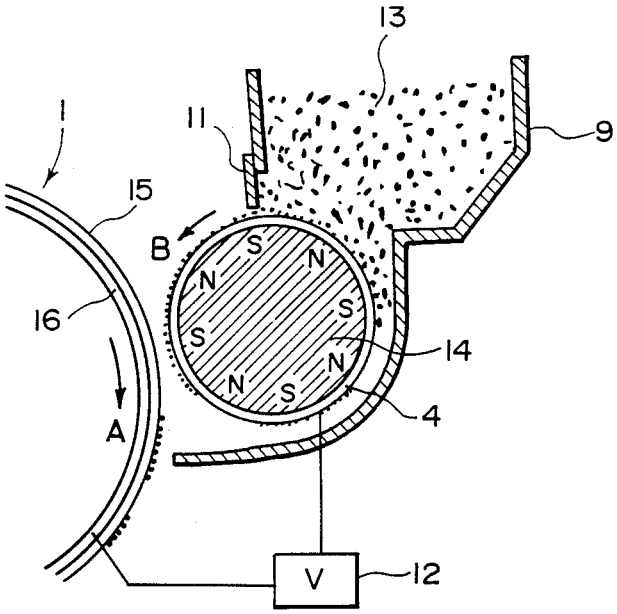
FIG. 4 is an enlarged partial schematic sectional view showing the developing region of the apparatus shown in FIG. 3.

Referring to FIGS. 3 and 4, the surface of a photosensitive member (drum) 1 is charged negatively or positively by means of a primary charger 2, and then an exposure light 5 comprising laser is supplied to the photosensitive member surface according to an image scanning method thereby to form a digital latent image thereon The latent image is developed with a one-component developer 13 to form a toner image in a developing position where a developing sleeve 4 of a developing device 9 is disposed opposite to the photosensitive member surface. The developing device 9 comprises a magnetic blade 11 and the developing sleeve 4 having a magnet 14 inside thereof, and contains the developer 13. In the developing position, a bias comprising an alternating bias, a pulse bias and/or a DC bias is applied between a electroconductive substrate 16 of the photosensitive drum 1 and the developing sleeve 4 by a bias application means 12, as shown in FIG. 4.

As shown in FIG. 3, when a transfer paper P is conveyed to a transfer position where a transfer charger 3 confronts the photosensitive drum 1, the back side surface of the transfer paper P (i.e., the surface thereof opposite to that confronting the photosensitive drum 1) is charged positively or negatively by means of the transfer charger 3, whereby the toner image comprising a negatively (or positively) chargeable toner formed on the photosensitive drum surface is electrostatically transferred to the transfer paper P. Then, the transfer paper P is separated from the photosensitive drum 1, and conveyed to a fixing device 7 using heat and pressure thereby to fix the toner image to the transfer paper P.

The residual one-component developer remaining on the photosensitive drum 1 downstream of the transfer position is removed by a cleaner 8 having a cleaning blade. The photosensitive drum 1 after the cleaning is discharged by erase exposure 6, and again subjected to the above-mentioned process including the charging step based on the primary charger 2, as the initial step.

Referring again to FIG. 4, the photosensitive drum 1, as an electrostatic imagebearing member, comprises a photosensitive layer 15 and the electroconductive substrate 16, and moves in the direction of an arrow A. On the other hand, the developing sleeve 4 of a nonmagnetic cylinder, as a developer-carrying member, rotates in the direction of an arrow B so as to move in the same direction as that of the photosensitive drum 1 in the developing position. The multipolar permanent magnet 14 is disposed inside the nonmagnetic cylinder 4 so as not to rotate.

The one-component insulating magnetic developer 13 contained in the developing apparatus 9 is applied onto the nonmagnetic sleeve 4, and the toner particles contained therein are supplied with triboelectric charge on the basis of the friction between the sleeve surface and the toner particles. A magnetic doctor blade of iron 11 is disposed close to the sleeve surface (preferably at a clearance of 50–500 microns) and opposite to one of the poles of the multipolar permanent magnet 14. Thus, the thickness of the toner layer disposed on the sleeve 4 is regulated uniformly and thinly (preferably in a thickness of 30–300 microns), thereby to form a developer layer having a thickness smaller than the clearance between the photosensitive drum 1 and the sleeve 4 in the developing position. The rotating speed of the sleeve 4 may be regulated so that the speed of the surface thereof is substantially the same as (or close to) the speed of the photosensitive drum surface.

The magnetic doctor blade 11 may also comprise a permanent magnet instead of iron thereby to form a counter magnetic pole. An AC bias or pulse bias may be applied between the sleeve 4 and the photosensitive drum 1 by means of the bias application means 12. The AC bias may preferably have a frequency of 200–4,000 Hz, and a Vpp (peak-to-peak value) of 500–3,000 V. In the developing position, the toner particles are transferred to an electrostatic image formed on the photosensitive drum 1 under the action of an electrostatic force due to the electrostatic image-bearing surface, and under the action of the AC bias or pulse bias.

In the above-mentioned embodiment, an elastic blade comprising an elastic or elastomeric material such as silicone rubber may also be used instead of the doctor blade 11, so that the developer is applied onto the developer-carrying member 4 while the thickness of the developer layer is regulated under pressure.

The present invention will be explained in further detail by way of Examples.

EXAMPLE 1

Spherical magnetic particles having a tap density of 1.0 g/cm$^3$, a linseed oil absorption of 25 ml/100 g and a BET specific surface area of 7 m$^2$/g were subjected to a disintegration treatment by means of a Fret mill to disintegrate the aggregates of the magnetic particles, thereby to prepare spherical magnetic particles having a tap density of 1.7 g/cm$^3$, a linseed oil absorption of 17 ml/100 g, and a BET specific surface area of 7 m$^2$/g. The thus prepared spherical magnetic particles had a saturation magnetization ($\sigma_s$) of 83 emu/g, a residual magnetization ($\sigma_r$) of 5 emu/g, a ratio of $\sigma_r/\sigma_s$ of 0.06, and a coercive force of 56 Öe.

The above-mentioned spherical magnetic

| | |
|---|---|
| The above-mentioned spherical magnetic particles after disintegration | 60 wt. parts |
| Styrene-butyl acrylate copolymer (copolymerization weight ratio = 8:2, weight-average molecular weight: about 250,000) | 100 wt. parts |
| Low-molecular weight polypropylene (weight-average molecular weight: about 15,000) | 3 wt. parts |
| Chromium complex of monoazo dye (Bontron S-34, mfd. by Orient Chemical K.K.) | 0.5 wt. parts |

The above components were melt-kneaded by means of a two-axis extruder heated up to 160° C., and the kneaded product, after cooling, was coarsely crushed by means of a hammer mill, and then finely pulverized by means of a jet mill. The finely pulverized product was classified by means of a windforce classifier thereby to prepare a magnetic toner.

When the particle size of the magnetic toner was measured by means of a Coulter counter Model TA-II with a 100 micron-aperture, the toner had a volume-average particle size of 11.5 microns and a percentage (%) by number of toner particles having particle sizes of below 6.35 microns of 20% by number. Further, the magnetic toner showed a triboelectric charge of −13 μC/g, when mixed with iron powder carrier.

100 wt. parts of the above magnetic toner were mixed with 0.8 wt. part of negatively chargeable hydrophobic silica which had been treated with dimethyldichlorosilane and silicone oil, by means of a Henschel mixer. Then, the resultant mixture was passed through a 100-mesh (Tyler mesh) screen, whereby powder passing through the screen was used as a negatively chargeable one-component magnetic developer. The above-mentioned magnetic toner and magnetic developer showed a volume resistivity of $5\times10^{14}$ Ω·cm.

The magnetic developer was subjected to a copying test by using a commercially available copying machine (trade name: Laser Beam Printer LBP-8AJ1, mfd. by Canon K.K.) having a laminate-type photosensitive drum comprising organic photoconductor (OPC). In the copying operation, the surface of the photosensitive drum was primarily charged to −700 V and then the surface was supplied with a laser beam corresponding to an original image comprising a checkered pattern as shown in FIG. 5, thereby to form a digital latent image wherein the exposed portion supplied with the laser beam had a potential of −100 V. The latent image was developed with the magnetic toner according to a reversal development method, while a DC bias of −500 V and an AC bias of 1800 Hz and 1600 V (peak-to-peak value) were applied between the photosensitive drum and a developing sleeve (developer-carrying member).

In the above developing operation, the minimum clearance between the developing sleeve of stainless steel and the photosensitive drum was set to 350 microns in the developing position, and the thickness of a developer layer disposed on the sleeve was set to about 100 microns in the developing position under no application of the bias.

As a result, the magnetic toner according to the present invention provided good copied images under any of normal temperature-normal humidity (25° C., 60% RH) condition, high temperature-high humidity (30° C., 90% RH) condition, and low temperature-low humidity (15° C., 10% RH) condition. Further, the thus obtained copied image corresponding to the checkered pattern as shown in FIG. 5 had no image defect.

When successive copying tests of 3,000 sheets were conducted under the respective conditions, the resultant toner image retained an image density of 1.35 or above and were excellent in reproducibility of thin lines.

When the surface of the OPC photosensitive drum was observed after the successive copying test of 3,000 sheets, there was observed no damage capable of causing a black or white streak in the toner image.

The results are shown in Table appearing hereinafter.

EXAMPLE 2

Spherical magnetic particles having a tap density of 0.8 g/cm$^3$, a linseed oil absorption of 25 ml/100 g and a BET specific surface area of 7 m$^2$/g were subjected to a disintegration treatment, thereby to prepare spherical magnetic particles having a tap density of 1.5 g/cm$^3$, a linseed oil absorption of 19 ml/100 g, and a BET specific surface area of 6.9 m$^2$/g.

A magnetic toner and a developer were prepared in the same manner as in Example 1 except that the above-prepared spherical magnetic particles were used instead of those used in Example 1.

The thus obtained developer was subjected to an image formation test in the same manner as in Example 1. The results are shown in Table appearing hereinafter.

EXAMPLE 3

Spherical magnetic particles having a tap density of 0.7 g/cm$^3$, a linseed oil absorption of 27 ml/100 g and a BET specific surface area of 6.5 m$^2$/g were subjected to a disintegration treatment, thereby to prepare spherical magnetic particles having a tap density of 2.0 g/cm$^3$, a linseed oil absorption of 15 ml/100 g, and a BET specific surface area of 6.3 m$^2$/g.

A magnetic toner and a developer were prepared in the same manner as in Example 1 except that the above-prepared spherical magnetic particles were used instead of those used in Example 1.

The thus obtained developer was subjected to an image formation test in the same manner as in Example 1. The results are shown in Table appearing hereinafter.

EXAMPLE 4

Spherical magnetic particles having a tap density of 0.8 g/cm$^3$, a linseed oil absorption of 25 ml/100 g and a BET specific surface area of 10 m$^2$/g were subjected to a disintegration treatment, thereby to prepare spherical magnetic particles having a tap density of 1.8 g/cm$^3$, a linseed oil absorption of 14 ml/100 g, and a BET specific surface area of 9.8 m$^2$/g.

A magnetic toner and a developer were prepared in the same manner as in Example 1 except that the above-prepared spherical magnetic particles were used instead of those used in Example 1.

The thus obtained developer was subjected to an image formation test in the same manner as in Example 1. The results are shown in Table appearing hereinafter.

COMPARATIVE EXAMPLE 1

A magnetic toner and a developer were prepared in the same manner as in Example 1 except that spherical magnetic particles having a tap density of 0.9 g/cm$^3$, a linseed oil absorption of 25 ml/100 g and a BET specific surface area of 7 m$^2$/g which had not been subjected to a disintegration treatment were used instead of those used in Example 1.

The thus obtained developer was subjected to an image formation test in the same manner as in Example 1.

As a result, there could be obtained a lower toner image density as compared with that in Example 1. Further, the copied image obtained from the original image comprising the checkered pattern as shown in FIG. 5 showed four image defects (i.e., four toner image portions of 100 microns × 100 microns were missing), with respect to 100 black portions.

The results are shown in Table appearing hereinafter.

COMPARATIVE EXAMPLE 2

Spherical magnetic particles having a tap density of 0.9 g/cm$^3$, a linseed oil absorption of 25 ml/100 g and a BET specific surface area of 7 m$^2$/g were subjected to a disintegration treatment, thereby to prepare spherical magnetic particles having a tap density of 2.7 g/cm$^3$, a linseed oil absorption of 9 ml/100 g, and a BET specific surface area of 6.7 m$^2$/g.

A magnetic toner and a developer were prepared in the same manner as in Example 1 except that the above-prepared spherical magnetic particles were used instead of those used in Example 1.

The thus obtained developer was subjected to an image formation test in the same manner as in Example 1. When the surface of the photosensitive drum was observed after the successive copying test, there was found damage due to the formation of the pellet of the spherical magnetic particles.

The results are shown in Table appearing hereinafter.

COMPARATIVE EXAMPLE 3

A magnetic toner and a developer were prepared in the same manner as in Example 1 except that a magnetic material having a tap density of 0.4 g/cm$^3$, a linseed oil absorption of 34 ml/100 g and a BET specific surface area of 7 m$^2$/g and predominantly comprising magnetic particles in a cubic crystal system which had not been subjected to a disintegration treatment were used instead of those used in Example 1.

The thus obtained developer was subjected to an image formation test in the same manner as in Example 1.

As a result, there could be obtained a lower toner image density as compared with that in Example 1. Further, the copied image obtained from the original image comprising the checkered pattern as shown in FIG. 5 showed 10 image defects, with respect to 100 black portions.

The results are shown in Table appearing hereinafter.

COMPARATIVE EXAMPLE 4

Magnetic particles in a cubic crystal system having a tap density of 0.4 g/cm$^3$, a linseed oil absorption of 34 ml/100 g and a BET specific surface area of 7 m$^2$/g were subjected to a disintegration treatment, thereby to prepare magnetic particles in a cubic crystal system having a tap density of 1.0 g/cm$^3$, a linseed oil absorption of 19 ml/100 g, and a BET specific surface area of 8.5 m$^2$/g.

A magnetic toner and a developer were prepared in the same manner as in Example 1 except that the above-prepared magnetic particles in the cubic crystal system were used instead of the spherical magnetic particles used in Example 1.

The thus obtained developer was subjected to an image formation test in the same manner as in Example 1. The results are shown in Table appearing hereinafter.

TABLE

| Example | Shape of magnetic particle | Rate of change in specific BET surface area (%) | Image density: Normal temp.-normal humidity 100 sheets | Normal temp.-normal humidity 3,000 sheets | High temp.-high humidity 100 sheets | High temp.-high humidity 3,000 sheets | Low temp.-low humidity 100 sheets | Low temp.-low humidity 3,000 sheets | Number of image defects *1 100 sheets | Number of image defects *1 3,000 sheets | Damage to photosensitive drum *2 |
|---|---|---|---|---|---|---|---|---|---|---|---|
| Example | | | | | | | | | | | |
| 1 | spherical | 0 | 1.4 | 1.4 | 1.3 | 1.4 | 1.35 | 1.4 | 0/100 | 3/100 | None |
| 2 | spherical | −1.4 | 1.4 | 1.4 | 1.2 | 1.3 | 1.35 | 1.4 | 0/100 | 2/100 | None |
| 3 | spherical | −3.1 | 1.4 | 1.4 | 1.3 | 1.3 | 1.3 | 1.4 | 0/100 | 4/100 | None |
| 4 | spherical | −2.0 | 1.4 | 1.4 | 1.3 | 1.4 | 1.3 | 1.4 | 1/100 | 4/100 | None |
| Com. Example | | | | | | | | | | | |
| 1 | spherical | — | 1.3 | 1.3 | 1.1 | 1.0 | 1.1 | 1.0 | 4/100 | 10/100 | None |
| 2 | spherical | −4.3 | 1.3 | 1.4 | 1.3 | 1.3 | 1.3 | 1.3 | 2/100 | 6/100 | Observed |
| 3 | cubic crystal | — | 1.2 | 1.1 | 0.8 | 0.8 | 0.9 | 0.9 | 10/100 | 20/100 | None |
| 4 | cubic crystal | 21.4 | 1.2 | 1.2 | 0.9 | 1.0 | 1.0 | 0.9 | 6/100 | 15/100 | None |

*1: Image defects corresponding to checkered pattern shown in FIG. 5 (per 100 black portions).
*2: Damage capable of causing a white or black streak in a fixed toner image after successive copying of 3,000 sheets.

EXAMPLE 5

Spherical magnetic particles having a tap density of 1.0 g/cm$^3$ and a linseed oil absorption of 20.3 ml/100 g were subjected to a disintegration treatment, thereby to prepare spherical magnetic particles having a tap density of 1.7 g/cm$^3$, a linseed oil absorption of 16.4 ml/100 g, The above-mentioned spherical magnetic

| | |
|---|---|
| The above-mentioned spherical magnetic | 60 wt. parts |

-continued

| | |
|---|---|
| particles after disintegration | |
| Styrene-butyl acrylate copolymer (copolymerization weight ratio = 8:2, weight-average molecular weight: about 250,000) | 100 wt. parts |
| Low-molecular weight polypropylene (weight-average molecular weight: about 15,000) | 3 wt. parts |
| Chromium complex of monoazo dye (Bontron S-34, mfd. by Orient Chemical K.K.) | 2 wt. parts |

The above components were melt-kneaded by means of a hot roller heated up to 160° C., and the kneaded product, after cooling, was coarsely crushed to about 2 mm by means of a hammer mill, and then finely pulverized to about 10 microns by means of a jet mill. The finely pulverized product was classified by means of a wind-force classifier thereby to prepare a magnetic toner. The thus prepared toner had a volume-average particle size of 11 microns and a percentage (%) by number of toner particles having particle sizes of below 6.35 microns of about 15% by number.

The above magnetic toner was mixed with 0.4 wt. % of negatively chargeable hydrophobic colloidal silica thereby to prepare a developer.

The developer was subjected to a copying test by using a commercially available copying machine (trade name: Laser Beam Printer LBP-8AJ1, mfd. by Canon K.K.). A successive copying test of 10,000 sheets was conducted under low temperature-low humidity conditions by using an original sample image wherein thin lines of 100 microns were arranged at a pitch of 100 microns. The resultant toner image retained an image density (Dmax) of 1.3 or above and were excellent in reproducibility of thin lines, from the initial stage.

EXAMPLE 6

Spherical magnetic particles having a tap density of 0.7 g/cm$^3$ and a linseed oil absorption of 30.8 ml/100 g were subjected to a disintegration treatment, thereby to prepare spherical magnetic particles having a tap density of 1.2 g/cm$^3$ and a linseed oil absorption of 25.2 ml/100 g.

A magnetic developer was prepared in the same manner as in Example 5 except that the above-prepared spherical magnetic particles were used instead of those used in Example 5.

The thus obtained developer showed good developing characteristics.

COMPARATIVE EXAMPLE 5

A magnetic developer was prepared in the same manner as in Example 5 except that magnetic particles in a cubic crystal system having a tap density of 1.4 g/cm$^3$, a linseed oil absorption of 23.2 ml/100 g were used instead of the spherical magnetic particles used in Example 5.

The thus obtained developer was subjected to an image formation test in the same manner as in Example 5.

As a result, the resultant image densities at the initial stage and after the successive copying were as low as 1.0 or below, and the developer did not show sufficient image forming characteristics.

COMPARATIVE EXAMPLE 6

A magnetic developer was prepared in the same manner as in Example 5 except that magnetic particles in a cubic crystal system having a tap density of 0.5 g/cm3, a linseed oil absorption of 18.0 ml/100 g were used instead of the spherical magnetic particles used in Example 5.

The thus obtained developer was subjected to an image formation test in the same manner as in Example 5.

As a result, the resultant image density at the initial stage was low, and the image density gradually decreased in the course the successive copying.

What is claimed is:

1. A magnetic toner, comprising a binder resin and a magnetic material comprising spherical magnetic particles, wherein the magnetic material has a tap density of 1.2–2.5 g/cm$^3$ and a linseed oil absorption of 5–30 ml/100 g.

2. A magnetic toner according to claim 1, wherein the magnetic material has a linseed oil absorption of 10–25 ml/100 g.

3. A magnetic toner according to claim 1, wherein the magnetic material has a linseed oil absorption of 12–17 ml/100 g.

4. A magnetic toner according to claim 1, wherein the magnetic material comprises spherical magnetic particles which have been obtained through a disintegration treatment conducted by a pressure dispersing machine having a load-applying roller for disintegration.

5. A magnetic toner according to claim 1, wherein the magnetic material has a coercive force of 40–80 Öe as measured at a magnetic field of 10,000 Öe.

6. A magnetic toner according to claim 5, wherein the magnetic material has a saturation magnetization ($\sigma_s$) of 60–90 emu/g, a residual magnetization ($\sigma_r$) of 3–9 emu/g, and a ratio of $\sigma_r/\sigma_s$ of 0.04–0.10 as measured at a magnetic field of 10,000 Öe.

7. A magnetic toner according to claim 1, wherein the magnetic material is contained in an amount of 30–150 wt. parts per 100 wt. parts of the binder resin.

8. A magnetic toner according to claim 7, wherein the binder resin comprises a styrene-acrylic acid alkyl ester copolymer.

9. A magnetic toner according to claim 7, wherein the binder resin comprises a styrenemethacrylic acid ester copolymer.

10. A magnetic toner according to claim 7, wherein the binder resin comprises a polyester resin.

11. A negatively chargeable one component-type developer, comprising a negatively chargeable magnetic toner and negatively chargeable hydrophobic silica fine powder, said magnetic toner comprising a binder resin, a negative charge controller, and a magnetic material comprising spherical magnetic particles, wherein the magnetic material has a tap density of 1.2–2.5 g/cm$^3$ and a linseed oil absorption of 5–30 ml/100 g.

12. A developer according to claim 11, wherein the magnetic material has a linseed oil absorption of 10–25 ml/100 g.

13. A developer according to claim 11, wherein the magnetic material has a linseed oil absorption of 12–17 ml/100 g.

14. A developer according to claim 11, wherein the magnetic material comprises spherical magnetic particles which have been obtained through a disintegration treatment conducted by a pressure dispersing machine having a load-applying roller for disintegration.

15. A developer according to claim 11, wherein the magnetic material has a coercive force of 40–80 Öe as measured at a magnetic field of 10,000 Öe.

16. A developer according to claim 15, wherein the magnetic material has a saturation magnetization ($\sigma_s$) of 60–90 emu/g, a residual magnetization ($\sigma_r$) of 3–9 emu/g, and a ratio of $\sigma_r/\sigma_s$ of 0.04–0.10 as measured at a magnetic field of 10,000 Öe.

17. A developer according to claim 11, wherein the magnetic material is contained in an amount of 30–150 wt. parts per 100 wt. parts of the binder resin.

18. A developer according to claim 17, wherein the binder resin comprises a styrene-acrylic acid alkyl ester copolymer.

19. A developer according to claim 17, wherein the binder resin comprises a styrene-methacrylic acid ester copolymer.

20. A developer according to claim 17, wherein the binder resin comprises a polyester resin.

21. A developer according to claim 11, wherein the negative charge controller is contained in an amount of 0.1–0.9 wt. part per 100 wt. parts of the binder resin.

22. A developer according to claim 11, wherein the silica fine powder is contained in an amount of 0.3–1.0 wt. part per 100 wt. parts of the magnetic toner.

23. An image forming method, comprising:

forming a digital latent image on the surface of a latent image-bearing member, forming a layer of developer comprising a magnetic toner on a developer-carrying member, said magnetic toner comprising a binder resin and a magnetic material comprising spherical magnetic particles, wherein the magnetic material has a tap density of 1.2–2.5 g/cm$^3$ and a linseed oil absorption of 5–30 ml/100 g, triboelectrically charging the magnetic toner, and transferring the magnetic toner having triboelectric charge from the developer-carrying member to the latent image-bearing member in a developing position in the presence of an alternating or a pulse electric field to form a toner image on the latent image-bearing member.

24. A method according to claim 23, wherein the alternating electric field is based on an AC bias component having a frequency of 200–4000 Hz and a peak-to-peak value (Vpp) of 500–3000 V.

25. A method according to claim 23, wherein a negative digital latent image is formed on the latent image-bearing member, and the magnetic toner has negative triboelectric charge.

26. An image forming method according to claim 23, wherein the magnetic material has a linseed oil absorption of 10–25 ml/100 g.

27. An image forming method according to claim 26, wherein the magnetic material has a linseed oil absorption of 12–17 ml/100 g.

28. An image forming method according to claim 23, wherein the magnetic material comprises spherical magnetic particles which have been obtained through a disintegration treatment conducted by a pressure dispersing machine having a load-applying roller for disintegration.

29. An image forming method according to claim 23, wherein the magnetic material has a coercive force of 40–80 Oe as measured at a magnetic field of 10,000 Oe.

30. An image forming method according to claim 29, wherein the magnetic material has a saturation magnetization ($\sigma_s$) of 60–90 emu/g, a residual magnetization ($\sigma_r$) of 3–9 emu/g, and a ratio of $\sigma_r/\sigma_s$ of 0.04–0.10 as measured at a magnetic field of 10,000 Oe.

31. An image forming method according to claim 23, wherein the magnetic material is contained in an amount of 30–150 wt. parts per 100 wt. parts of the binder resin.

* * * * *

UNITED STATES PATENT AND TRADEMARK OFFICE

CERTIFICATE OF CORRECTION

PATENT NO. : 4,935,325

DATED : June 19, 1990

INVENTOR(S) : Kuribayashi et al.

It is certified that error appears in the above-identified patent and that said Letters Patent is hereby corrected as shown below:

COLUMN 1:

Line 32, "easier" should read --more easily--.

COLUMN 4:

Line 13, "measurement cap" should read --measurement cup --.

Line 17, "cap the" should read --cap. The--.

COLUMN 5:

Line 67, "crystal," should read --crystal--.

COLUMN 6:

Line 60, "overstep" should read --oversteps--.

Line 61, "thereof there occurs," should read --thereof, there occurs--.

Line 66, "increase" should read --increases--.

COLUMN 7:

Line 6, "decrease" should read --decreases--.

UNITED STATES PATENT AND TRADEMARK OFFICE

CERTIFICATE OF CORRECTION

PATENT NO. : 4,935,325 Page 2 of 3

DATED : June 19, 1990

INVENTOR(S) : Kuribayashi et al.

It is certified that error appears in the above-identified patent and that said Letters Patent is hereby corrected as shown below:

COLUMN 8:

Line 2, "styrenemethyl" should read --styrene-methyl--.

Line 9, "styrenevinyl" should read --styrene-vinyl--.

Line 10, "styrene-acrylonitrileindene" should read --styrene-acrylonitrile-indine--.

COLUMN 9:

Line 50, "thereon The" should read --thereon. The--.

Line 59, "a" should read --an--.

COLUMN 10:

Line 16, "imagebearing" should read --image-bearing--.

COLUMN 11:

Line 10 should be deleted.

Line 28, "windforce" should read --wind-force--.

UNITED STATES PATENT AND TRADEMARK OFFICE

CERTIFICATE OF CORRECTION

PATENT NO. : 4,935,325 Page 3 of 3

DATED : June 19, 1990

INVENTOR(S) : Kuribayashi et al.

It is certified that error appears in the above-identified patent and that said Letters Patent is hereby corrected as shown below:

COLUMN 14:

Line 64, "g," should read --g.--.

Line 65 should be deleted.

COLUMN 16:

Line 5, "0.5 g/cm3," should read --0.5 g/$cm^3$,--.

Line 48, "styrenemethacrylic" should read --styrene-methacrylic--.

Signed and Sealed this

Third Day of August, 1993

Attest:

Michael K. Kirk

MICHAEL K. KIRK

Attesting Officer

Acting Commissioner of Patents and Trademarks